US007032994B2

(12) United States Patent
O'Hara et al.

(10) Patent No.: US 7,032,994 B2
(45) Date of Patent: Apr. 25, 2006

(54) INTERCONNECT CIRCUIT

(75) Inventors: Steve O'Hara, Camas, WA (US); Naoto Kawamura, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 168 days.

(21) Appl. No.: 10/699,275

(22) Filed: Oct. 31, 2003

(65) Prior Publication Data

US 2005/0093943 A1 May 5, 2005

(51) Int. Cl.
*B41J 2/14* (2006.01)

(52) U.S. Cl. ..... 347/50

(58) Field of Classification Search ..... 347/49, 347/50, 58, 86, 97; 361/229; 439/65, 67, 439/74

See application file for complete search history.

(56) References Cited

U.S. PATENT DOCUMENTS

| | | | | |
|---|---|---|---|---|
| 4,803,500 | A | 2/1989 | Milbrandt | |
| 4,872,027 | A | 10/1989 | Buskirk et al. | |
| 4,907,018 | A * | 3/1990 | Pinkerpell et al. | 346/139 R |
| 5,411,343 | A * | 5/1995 | Childers | 400/692 |
| 5,461,405 | A | 10/1995 | Lehmann et al. | |
| 5,589,859 | A * | 12/1996 | Schantz | 347/19 |
| 5,706,040 | A | 1/1998 | Reid et al. | |
| 5,742,306 | A | 4/1998 | Gompertz et al. | |
| 5,831,649 | A | 11/1998 | Watrobski et al. | |
| 5,852,460 | A * | 12/1998 | Schaeffer et al. | 347/87 |
| 5,904,507 | A | 5/1999 | Thomas | |
| 5,971,525 | A * | 10/1999 | Inoue et al. | 347/50 |
| 6,161,915 | A | 12/2000 | Bolash et al. | |
| 6,174,046 | B1 | 1/2001 | Reid et al. | |
| 6,536,871 | B1 | 3/2003 | Haddick et al. | |
| 6,604,814 | B1 | 8/2003 | Browning et al. | |
| 2003/0063157 | A1 | 4/2003 | Browning et al. | |
| 2003/0063158 | A1 | 4/2003 | Browning et al. | |
| 2003/0122897 | A1 | 7/2003 | Chou et al. | |
| 2005/0093942 | A1 * | 5/2005 | Kawamura et al. | 347/86 |

FOREIGN PATENT DOCUMENTS

| | | |
|---|---|---|
| EP | 0571093 | 11/1993 |
| WO | PCT/US2004/034799 | 3/2005 |

* cited by examiner

*Primary Examiner*—Anh T. N. Vo

(57) ABSTRACT

A print cartridge includes a cartridge body having a lower portion and a vertical wall. A printhead is attached to the lower portion of the cartridge body. A contact array having a first pair of columnar arrays of contact areas and a second pair of columnar arrays of contact areas is disposed on the vertical wall of the cartridge. The columnar arrays extending along at least one half of the height of a region occupied by the contact array. The columnar arrays of each pair of columnar arrays converge toward each other in a direction toward the lower portion of the cartridge body.

28 Claims, 10 Drawing Sheets

Fig. 13
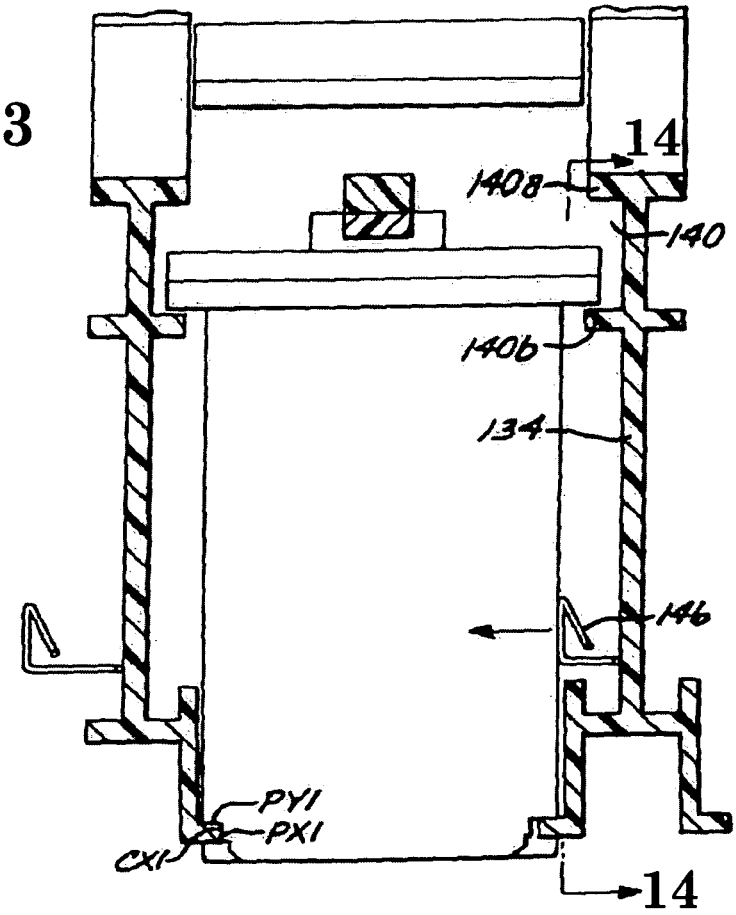
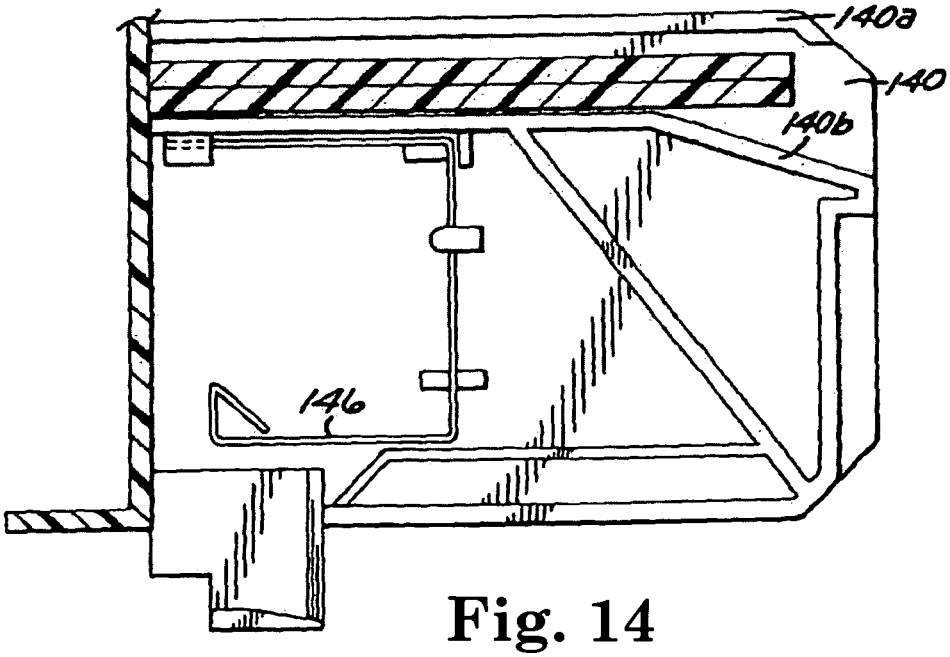
Fig. 14

INTERCONNECT CIRCUIT

BACKGROUND

An inkjet printer forms a printed image by printing a pattern of individual dots at particular locations of an array defined for the printing medium. The locations may be visualized as being small dots in a rectilinear array. The locations are sometimes called "dot locations," "dot positions," or "pixels." Thus, a printing operation can be viewed as providing a pattern of dot locations with dots of ink.

Inkjet printers print pixels by ejecting drops of ink from ink ejecting nozzles onto the print medium and typically include a movable print carriage that supports one or more print cartridges. The print carriage traverses axially above the surface of the print medium, while the nozzles are controlled to eject drops of ink at appropriate times pursuant to command of a microcomputer or other controller. The timing of the application of the ink drops is intended to correspond to the pattern of pixels of the image being printed.

The particular ink ejection mechanism within the printhead may take on a variety of different forms known to those skilled in the art, such as those using thermal ejection or piezoelectric technology. For instance, two exemplary thermal ejection mechanisms are shown in commonly assigned U.S. Pat. Nos. 5,278,584 and 4,683,481. In a thermal ejection system, an ink barrier layer containing ink channels and ink vaporization chambers is disposed between a nozzle orifice plate and a thin film substrate. The thin film substrate typically includes arrays of heater elements such as thin film resistors which are selectively energized to heat ink within the vaporization chambers. When the heater elements are energized, an ink droplet is ejected from a nozzle associated with the heater element. By selectively energizing heater elements, ink drops are ejected onto the print medium in a pattern to form the desired image.

Certain inkjet printers employ replaceable print cartridges, and a consideration with such printers is the need for a reliable electrical interface between a print cartridge and the printer in which it is installed.

SUMMARY

One aspect of the present invention provides a print cartridge. The print cartridge includes a cartridge body having a lower portion and a vertical wall. A printhead is attached to the lower portion of the cartridge body. A contact array having a first pair of columnar arrays of contact areas and a second pair of columnar arrays of contact areas is disposed on the vertical wall of the cartridge. The columnar arrays extend along at least one half of the height of a region occupied by the contact array. The columnar arrays of each pair of columnar arrays converge toward each other in a direction toward the lower portion of the cartridge body.

BRIEF DESCRIPTION OF THE DRAWINGS

FIG. 13 is a schematic sectional elevational view of the embodiment of a chute of the print cartridge of FIG. 7.

FIG. 14 is a schematic sectional elevational view of the embodiment of a side wall of a chute of the print cartridge of FIG. 7.

DETAILED DESCRIPTION

In the following Detailed Description, reference is made to the accompanying drawings which form a part hereof, and in which is shown by way of illustration particular embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
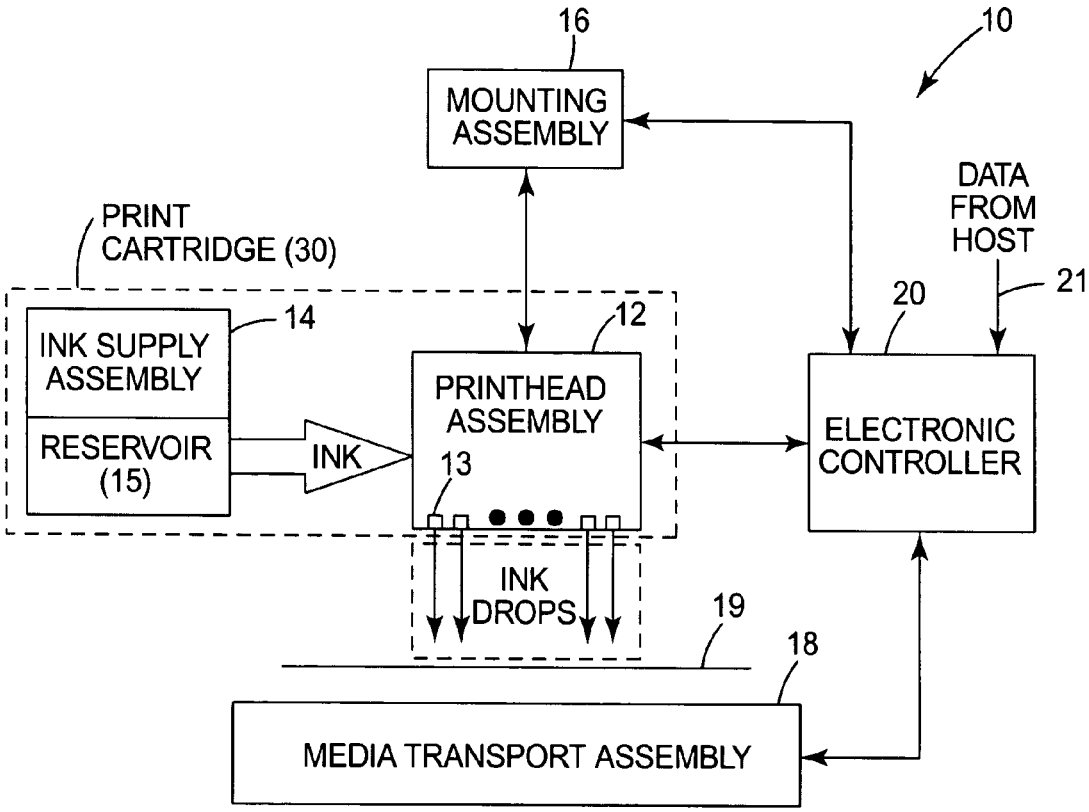
FIG. 1 is a block diagram illustrating one embodiment of an ink-jet printing system.

FIG. 1 illustrates one embodiment of an inkjet printing system 10. Ink-jet printing system 10 includes an inkjet printhead assembly 12 and an ink supply assembly 14. In the illustrated embodiment, inkjet printing system 10 also includes a mounting assembly 16, a media transport assembly 18, and an electronic controller 20.

Inkjet printhead assembly 12 includes one or more print heads which eject drops of ink or fluid through a plurality of orifices or nozzles 13. In one embodiment, the drops are directed toward a medium, such as print medium 19, so as to print onto print medium 19. Print medium 19 may be any type of suitable sheet material, such as paper, card stock, transparencies, Mylar, fabric, and the like. Typically, nozzles 13 are arranged in one or more columns or arrays such that properly sequenced ejection of ink from nozzles 13 causes, in one embodiment, characters, symbols, and/or other graphics or images to be printed upon print medium 19 as inkjet printhead assembly 12 and print medium 19 are moved relative to each other.

Ink supply assembly 14 supplies ink to printhead assembly 12 and includes a reservoir 15 for storing ink. As such, in one embodiment, ink flows from reservoir 15 to inkjet printhead assembly 12. In one embodiment, ink-jet printhead assembly 12 and ink supply assembly 14 are housed together in an inkjet or fluidjet cartridge or pen, also referred to as a print cartridge. In another embodiment, ink supply assembly 14 is separate from inkjet printhead assembly 12 and supplies ink to inkjet printhead assembly 12 through an interface connection, such as a supply tube (not shown).

Mounting assembly 16 positions inkjet printhead assembly 12 relative to media transport assembly 18, and media transport assembly 18 positions print medium 19 relative to inkjet printhead assembly 12. In one embodiment, ink-jet printhead assembly 12 is a scanning type printhead assembly and mounting assembly 16 includes a carriage (not shown) for moving inkjet printhead assembly 12 relative to media transport assembly 18. In another embodiment, inkjet printhead assembly 12 is a non-scanning type printhead assembly, e.g. a page wide printhead assembly, and mounting assembly 16 fixes ink-jet printhead assembly 12 at a prescribed position relative to media transport assembly 18.

Electronic controller 20 communicates with inkjet printhead assembly 12, mounting assembly 16, and media transport assembly 18. Electronic controller 20 receives data 21 from a host system, such as a computer, and usually includes memory for temporarily storing data 21. Typically, data 21 is sent to inkjet printing system 10 along an electronic, infrared, optical or other information transfer path. Data 21 represents, for example, a document and/or file to be printed. As such, data 21 forms a print job for inkjet printing system 10 and includes one or more print job commands and/or command parameters.

In one embodiment, electronic controller 20 provides control of ink-jet printhead assembly 12 including timing control for ejection of ink drops from nozzles 13. As such, electronic controller 20 defines a pattern of ejected ink drops which form characters, symbols, and/or other graphics or images on print medium 19. Timing control and, therefore, the pattern of ejected ink drops is determined by the print job commands and/or command parameters. In one embodiment, at least a portion of logic and drive circuitry forming a portion of electronic controller 20 is located on inkjet printhead assembly 12. In another embodiment, at least a portion of logic and drive circuitry is located off ink-jet printhead assembly 12.

Inkjet printing system 10 of FIG. 1 constitutes one embodiment of a fluid ejection system which includes a fluid ejection device. In other embodiments, inkjet printing system 10 can be a fluid ejection system that ejects any desired liquid onto a desired surface. Embodiments of fluid ejection devices used in fluid ejection systems include, but are not limited to, inkjet printheads, inkjet print cartridges or pens, fluidjet print cartridges or pens, fluid ejecting integrated circuits, and fluid ejecting nozzles.

Figure 2:
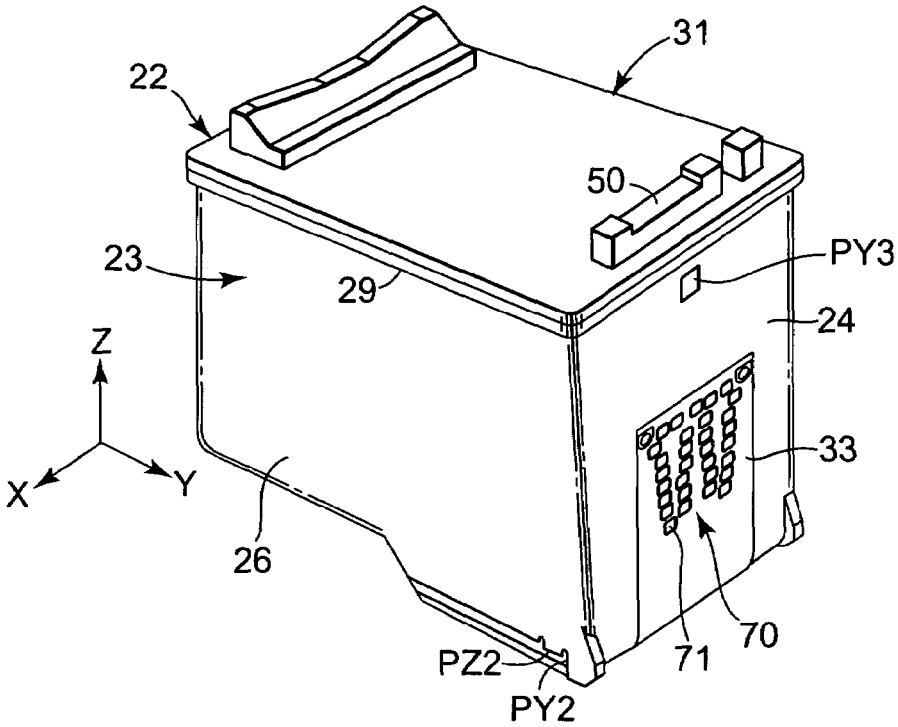
FIG. 2 is a schematic perspective view of an embodiment of an ink-jet print cartridge.
Figure 3:
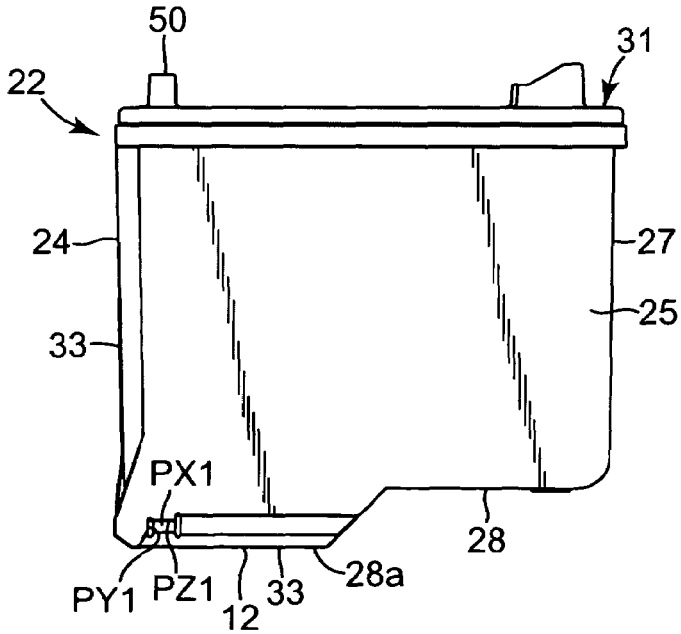
FIG. 3 is a schematic side elevational view of the embodiment of the inkjet print cartridge of FIG. 2.
Figure 4:
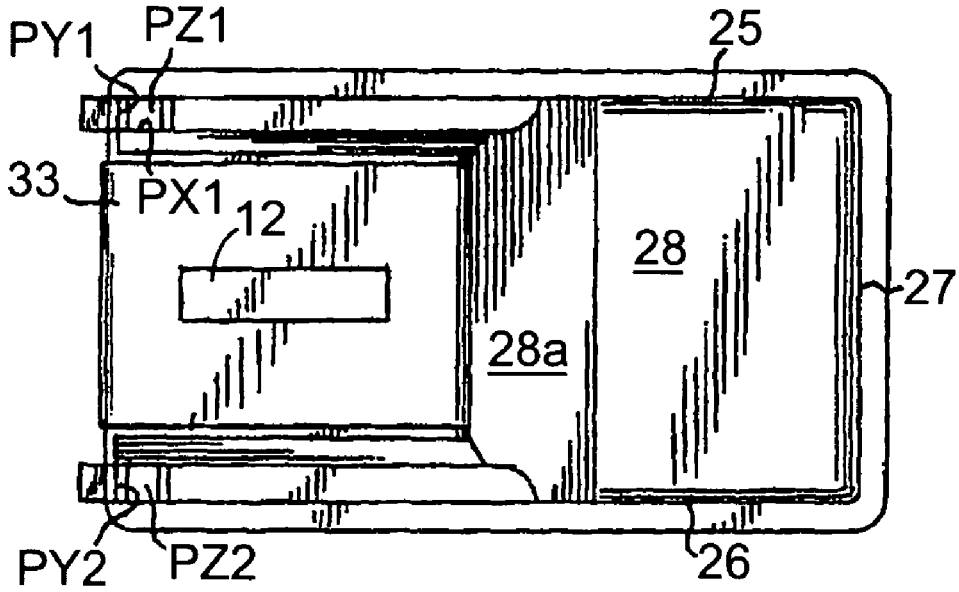
FIG. 4 is a schematic bottom plan view of the embodiment of the ink-jet print cartridge of FIG. 2.

FIGS. 2–4 illustrate one embodiment of a print cartridge 22. The print cartridge 22 includes a housing 23 that supports inkjet printhead assembly 12 and contains reservoir 15 of ink supply 14. As such, reservoir 15 communicates with inkjet printhead assembly 12 to supply ink to inkjet printhead assembly 12, as is well known in the art. Housing 23 is comprised of a rear wall 24, a left side wall 25, a right side wall 26, a front wall 27, and a bottom wall 28 that includes a snout section 28*a* that supports an inkjet printhead assembly 12. A top wall or lid 31 is attached to the upper edges of the front, side, and rear walls, and includes margins or lips 29 that extend beyond the front and side walls. A latch catch or feature 50 is disposed on the lid 31 close to the top boundary of the rear wall 24. The latch feature 50 extends upwardly from the top wall 31.

Other shapes may be utilized for housing 23, including, but not limited to, cubic, triangular, etc. Further, snout section 28*a* and lips 29 may be omitted depending on the design parameters.

Located in the vicinity of the intersection of the left side wall 25, rear wall 24 and snout 28*a* are a printhead cartridge X axis datum PX1, a first printhead cartridge Y axis datum PY1, and a first printhead cartridge Z axis datum PZ1. Located in the vicinity of the intersection of the right side wall 26, rear wall 24 and snout 28*a* are a second printhead cartridge Y axis datum PY2 and a second printhead cartridge Z axis datum PZ2. A third printhead cartridge Y axis datum PY3 is located in the upper portion of the rear wall 24. The print cartridge Y axis datums generally comprise lands that are configured to be generally orthogonal to the Y axis when the cartridge is installed in the mounting assembly 16. The print cartridge Z axis datums comprise lands that are configured to be generally orthogonal to the Z axis when the print cartridge is installed in the mounting assembly 16. The print cartridge X axis datum comprises land that is configured to be generally orthogonal to the X axis when the print cartridge is installed in the mounting assembly 16. As described further herein, the datums of the cartridge engage corresponding datums in the mounting assembly 16.

Other numbers, locations and combinations of datums may be utilized on cartridge 22, or datums may be omitted entirely, depending on the design parameters.

Disposed on the rear wall 24, but which can be located on one the other walls depending on design parameters, is an electrical circuit 33 that provides electrical interconnection between the printer and the printhead 15. Electrical circuit 33 facilitates communication of electrical signals between electronic controller 20 and inkjet printhead assembly 12 for controlling and/or monitoring operation of inkjet printhead assembly 12.

Electrical circuit 33 includes an array 70 of electrical contact areas 71 and a plurality of conductive paths 77 (best seen in FIGS. 5 and 6) that extend between and provide electrical connection between electrical contact areas 71 and bond pads 74 on the inkjet printhead assembly 12. As such, electrical contact areas 71 provide points for electrical connection with printing cartridge 22 and, more specifically, inkjet printhead assembly 12. In one embodiment according to the invention, electrical circuit 33 is a flexible electrical circuit, and conductive paths 77 are formed in one or more layers of a flexible base material. The base material may include, for example, a polyimide or other flexible polymer material (e.g., polyester, poly-methyl-methacrylate) and conductive paths 77 may be formed of copper, gold, or any other conductive material.

Figure 5:
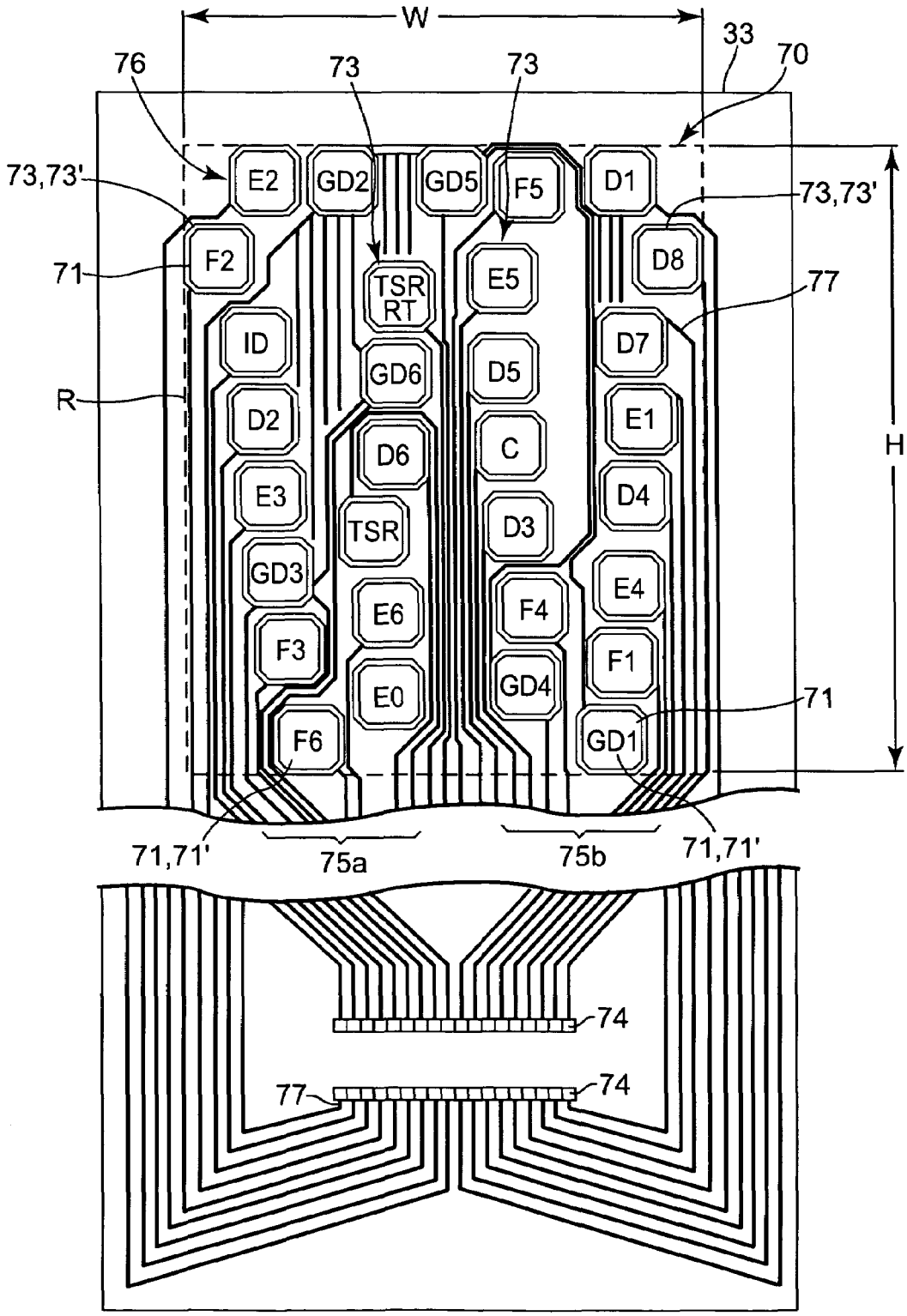
FIG. 5 is a schematic detail view of an embodiment of a flexible circuit of the inkjet print cartridge of FIG. 2.
Figure 10:
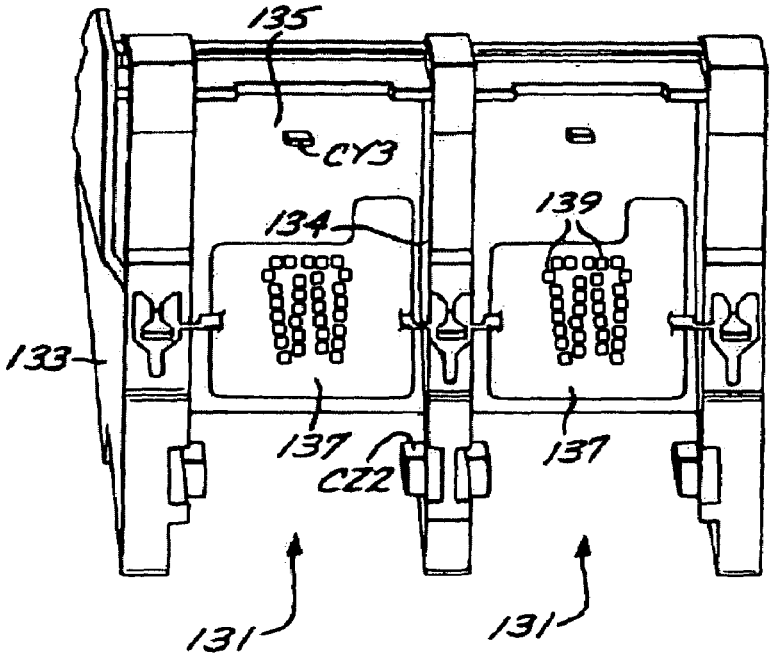
FIG. 10 is a schematic partial front perspective view of the embodiment of the print carriage of FIG. 7, with the cartridges and the latch assemblies removed.
Figure 11:
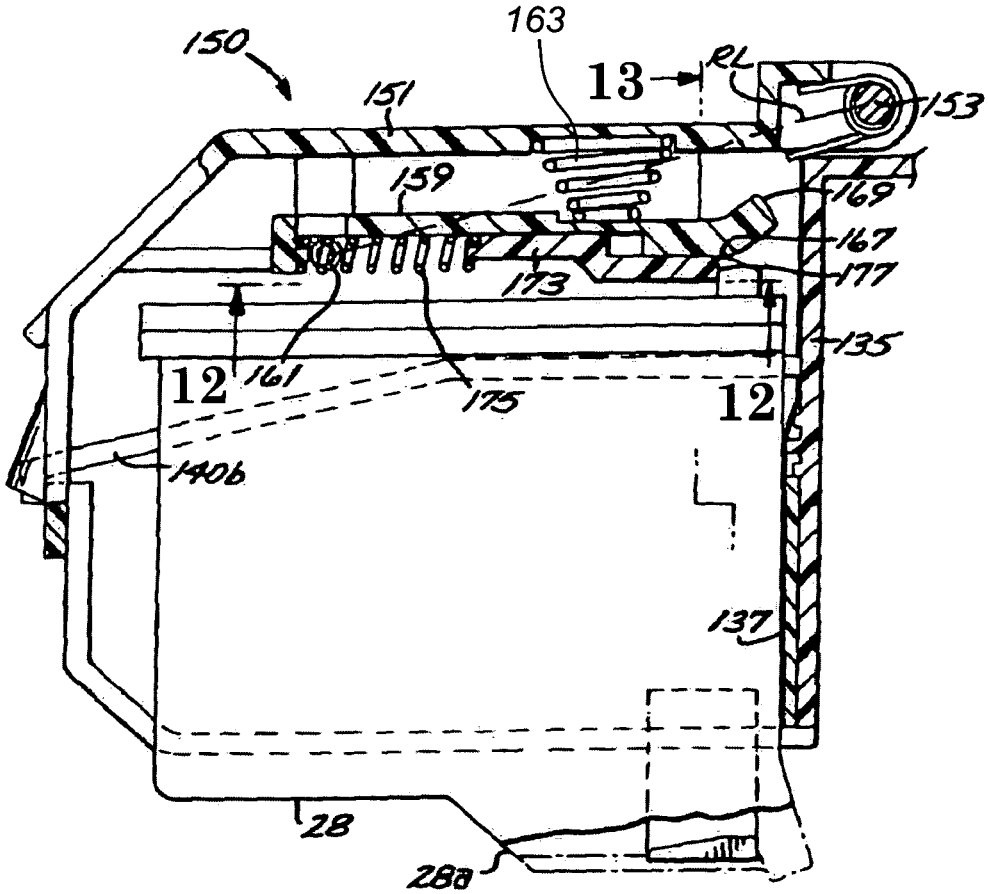
FIG. 11 is a schematic sectional elevational view of an embodiment of a chute and latch assembly of the print carriage of FIG. 7.
Figure 12:
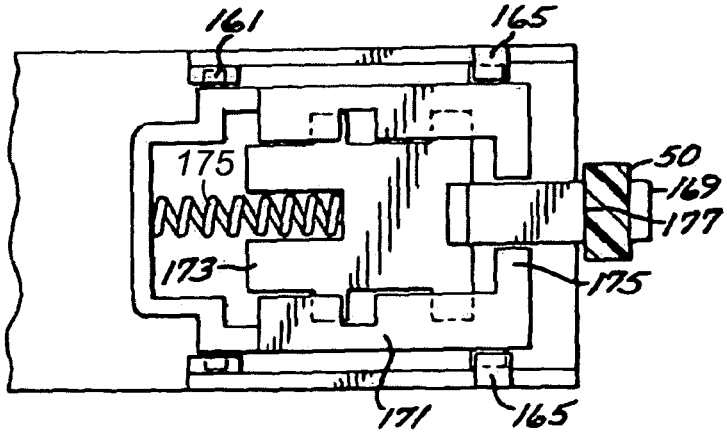
FIG. 12 is a schematic plan view of a pivoting clamp of the latch assembly of the print cartridge of FIG. 7.

FIG. 5 is a schematic depiction of an embodiment of the flexible circuit 33. Contact areas 71 are contactively engageable from the near side of the flexible circuit 33 which is the side that is away from the cartridge body. The side of the flexible circuit 33 that is against the cartridge body is called the far side. The contact areas 71 are disposed on a portion of the flexible circuit 33 that is located on the rear wall 24, and comprise electrically conductive areas that are contactively engageable with corresponding contact bumps 139 on a resilient contact circuit 137 (FIG. 10) located in the mounting assembly 16 (FIG. 1). In the embodiment depicted in FIG. 5, the flexible circuit 33 is formed of a flexible substrate on one side thereof and includes openings so that portions of the conductive pattern can be contacted from the other side of flexible circuit 33. In such implementation, the contact areas 71 comprise conductive areas exposed by openings in the flexible substrate. The contact areas 71 can be circular, octagonal, square, square with rounded or beveled corners, or any other shape or geometry.

The contact areas 71 are more particularly arranged in a plurality of adjacent, transversely separated columnar arrays 73 of contact areas 71. Each columnar array 73 includes a lower contact area 71' that is closest to the bottom wall 28 of the print cartridge 22. By way of illustrative example, one or more of the columnar arrays 73 can be substantially nonlinear. The substantially nonlinear arrangement of contact areas 71 within columnar arrays 73 allows the positioning of contact areas 71 to provide space where it is needed for conductive paths 77 to pass by where space is limited. The columnar arrays 73 are arranged in side by side pairs or groups 75*a*, 75*b* of columnar arrays 73. As shown in FIG. 5, there can be two pairs 75*a*, 75*b* of columnar arrays 73 so as to have four columnar arrays 73 of contact areas 71. The columnar arrays 73 of each pair 75*a*, 75*b* are arranged to converge toward each other in the direction toward the bottom wall 28 of the cartridge 22.

The contact array 70 further includes a horizontal row 76 of contact areas 71 substantially perpendicular to the columnar arrays 73. Row 76 is positioned adjacent the top of contact array 70. The horizontal row 76 makes efficient use of space within contact array 70, thereby reducing the number of required columnar arrays 73 and allowing the array 70 to be more narrow. Other array shapes and layouts different that those depicted herein may be utilized in the present embodiments.

The outermost transversely separated columnar arrays designated 73' can have more contact areas 71 than the columnar arrays 73 between such outermost transversely separated columnar arrays 73'. By way of example, each outermost columnar array 73' may include at least seven contact areas 71, and each of the other columnar arrays 73 may include at least six contact areas 71. Additionally, the outermost transversely separated columnar arrays 73' may have fewer or the same number of contact areas 71 as columnar arrays 73.

The spacing between contact areas 71 is asymmetric, which allows a reduction of the size of array 70, as compared to symmetric spacing. When the cartridge 22 is used in a printer, the flexible circuit 33 of cartridge 22 mates with resilient contact circuit 137 of the printer. The resilient contact circuit 137 has design constraints for spacing between contact bumps 139, as well as spacing between contact bumps 139 and conductive paths. The resilient contact circuit 137 may route the conductive paths (not shown) away from the contact bump 139 array in the opposite direction from the direction that the conductive paths 77 are routed. Many of the conductive paths on both flexible circuit 33 and resilient contact circuit 137 are routed between contact areas 71 and contact bumps 139, respectively. In instances where this is done, the contact areas 71 and contact bumps 139 may be spaced farther apart from each other. However, when there is not a conductive path between adjacent contact areas 71 or adjacent contact bumps 139, the contact areas 71 and contact bumps 139 can be spaced closer together. By utilizing asymmetric spacing of contact areas 71, columnar arrays 73 can be shorter than a columnar array with symmetric spacing, since space is not wasted when conductive paths are not routed between contact areas 71 on flexible circuit 33, or between contact bumps 139 on the resilient contact circuit 137 of the printer.

Figure 6:
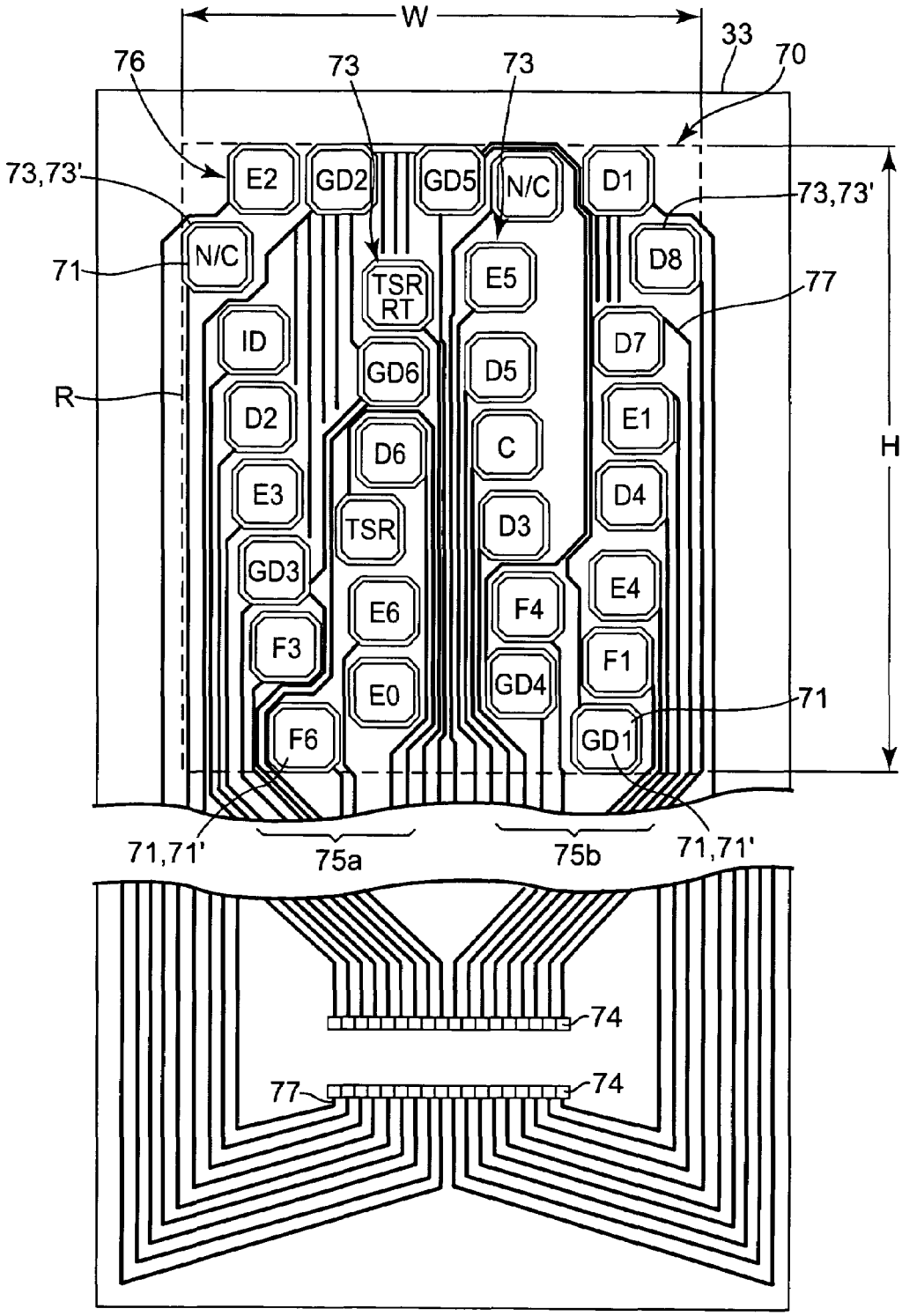
FIG. 6 is a schematic detail view of another embodiment of a flexible circuit of the inkjet print cartridge of FIG. 2.
Figure 7:
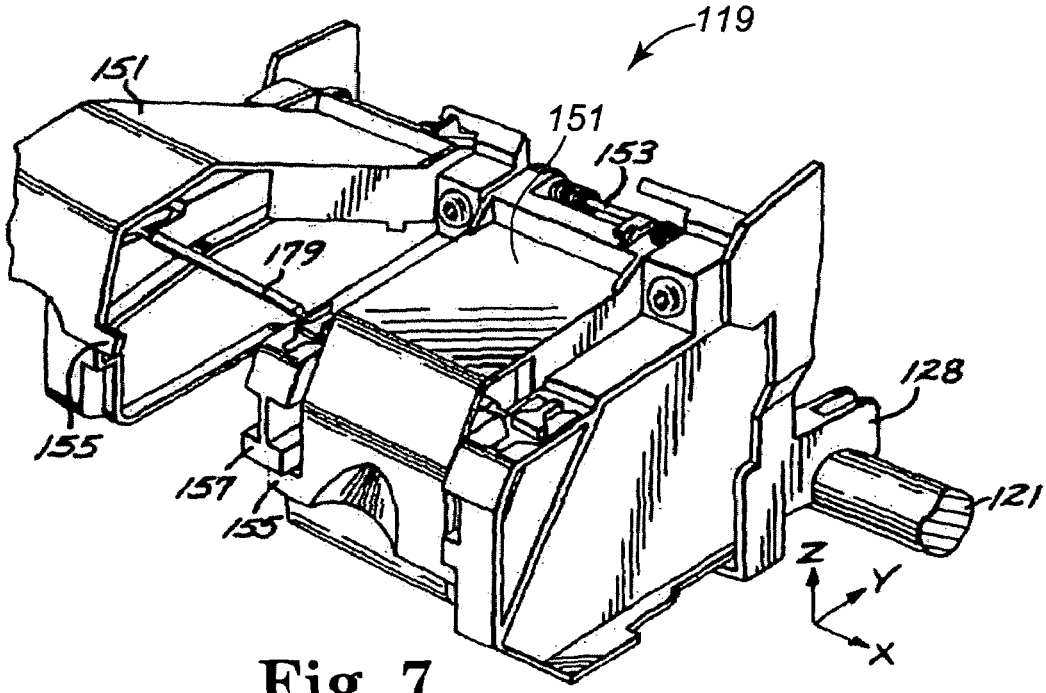
FIG. 7 is a schematic perspective view of an embodiment of a print carriage used in the mounting assembly of FIG. 1.
Figure 8:
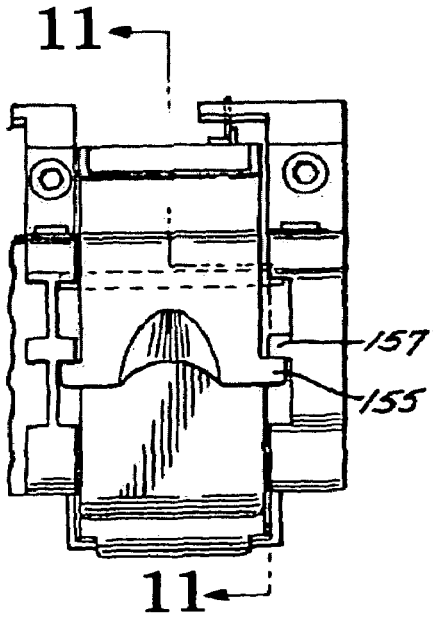
FIG. 8 is a schematic front elevational view of an embodiment of a chute and latch of the print carriage of FIG. 7.
Figure 9:
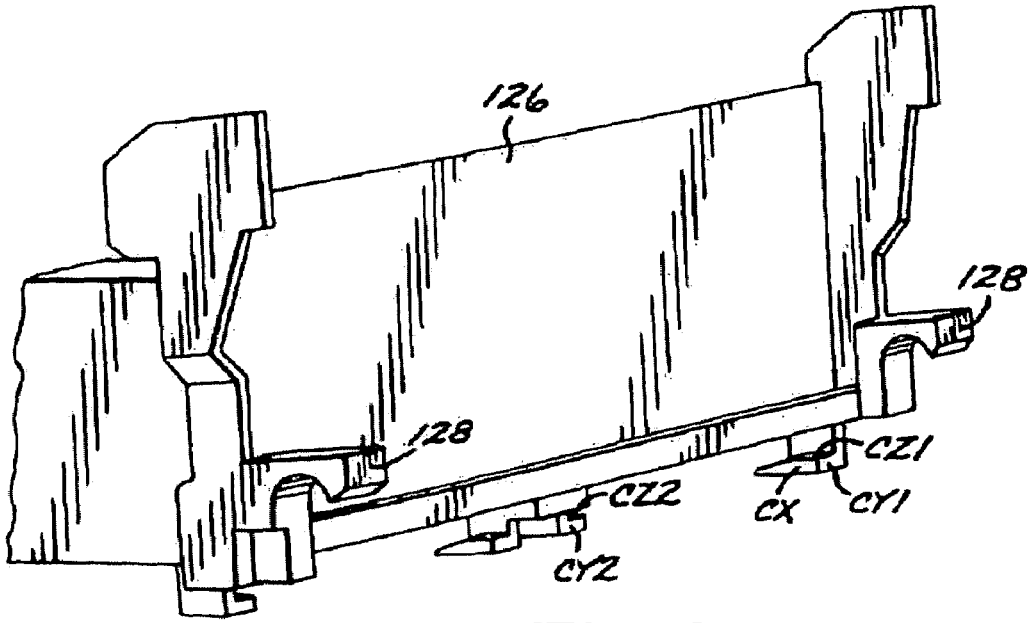
FIG. 9 is a schematic partial rear perspective view of the embodiment of the print carriage of FIG. 7, with the cartridges and the latch assemblies removed.
Figure 15A:
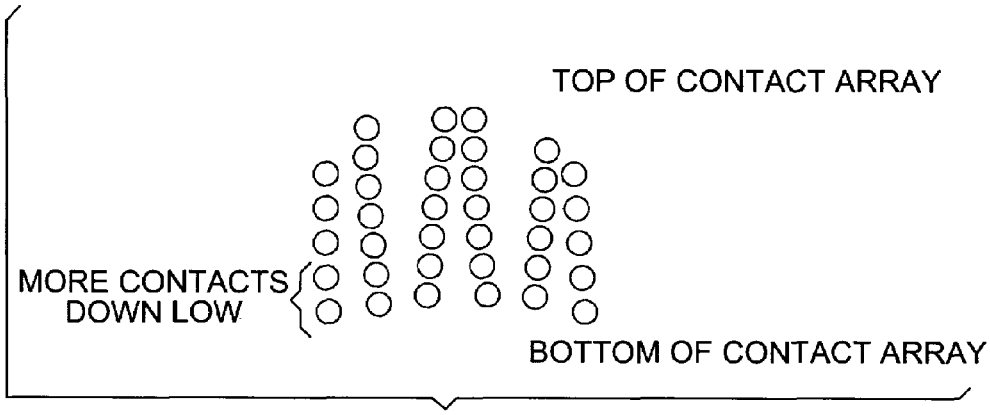
FIGS. 15A and 15B are schematic illustrations of an embodiment of a contact array having more contact areas near the bottom of the array, and a contact array having fewer contact areas near the bottom of the array, respectively.
Figure 15B:
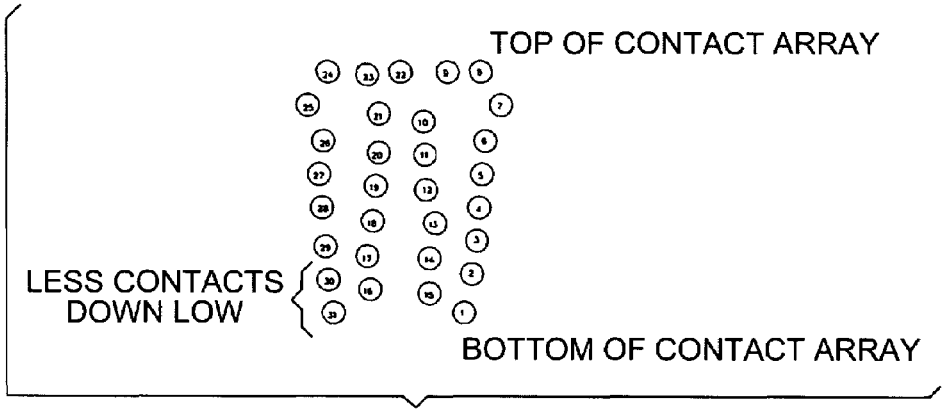

In one embodiment according to the invention, where nonlinear arrays 73, asymmetric spacing of contact areas 71, and horizontal row 76 of contact areas 71 are utilized, as illustrated in FIGS. 5, 6 and 15B, the overall array 70 area is approximately 13.7 mm×11.3 mm. An equivalent array using linear, evenly spaced contact areas, as illustrated in FIG. 15A, measures about 13.7 mm×12.2 mm. The approximately 1 mm reduction in the width W of the array allows the flexible circuit 33 to be laid out in 3 pitches (4.75 mm per pitch) of a 48 mm flexible circuit, as opposed to 4 pitches. This alone results in a savings of approximately 25% of the area for the array 70. In alternate embodiments according to the invention, the region occupied by the contact array has a height and a width up to the height and width of rear wall 24 of print cartridge 22.

In one embodiment according to the invention, less than one half of the contact areas 71 are positioned in the lower half of the smallest rectangle R, and columnar arrays 73 extend along at least one half of the height of the smallest rectangle R. By way of example, the smallest rectangle R has a height of about 13.7 mm and a width W of about 11.3 mm. Specifically, the rectangle R has a width of less than about 12 mm. The contact areas 71 of the columnar arrays 73 can be spaced center to center from each other by distances of less than 1 mm, about 1 to 3 mm, and greater than 3 mm.

Depending upon implementation, some or all of the contact areas 71 may be electrically connected to the inkjet printhead assembly 12 by the conductive traces generally indicated by the reference designation 77. The conductive traces are preferably disposed on the far side of the flexible circuit 33, which is the side against the cartridge housing, and lead to bond pads 74 on the ink-jet printhead assembly 12 (FIG. 5).

In the exemplary embodiment of FIG. 5, the contact areas 71 include enable line contact areas E1–E6 configured to receive signals which enable energizing of heater elements; data line contact areas D1–D8 configured to receive signals which provide print data representative of an image to be printed; fire line contact areas F1–F6 configured to receive timed energy pulses employed to heat ink to be ejected from heater elements; ground line contact areas GD1–GD6; a control signal contact area C configured to receive a signal for controlling the internal operation of the printhead; a temperature sense resistor contact area TSR; a temperature sense resistor return contact area TSR-RT; and an identification bit contact area ID.

In an illustrative embodiment, all of the ground contact areas GD1–GD6 are interconnected by ground traces 79 that are on the flexible circuit 33. Such ground traces 77 can more particularly be located close to the columnar arrays 73 so as to be only on the portion of the flexible circuit that is on the rear-wall of the print cartridge body.

FIG. 6 shows a contact array similar to that in FIG. 5, but wherein two contact areas labeled NC are not used.

The ground contact areas GD1–GD5 of the flexible interconnect circuits of FIGS. 5 and 6 can be in different locations, and be interconnected by conductive ground traces that are disposed only on the portion of the flexible circuit 33 that is on the rear wall of the print cartridge body, for example.

Referring now to FIGS. 7–14, one embodiment of a portion of mounting assembly 16 is illustrated. Mounting assembly 16 includes a print carriage 119 having a base 126 that supports the structure, and two bearings 128 located at the ends of the base 126. Bearings 128 slidably support the print carriage 119 on slider rod 121. The print carriage 119 further includes two chutes 131 that each receive, hold, and align an inkjet print cartridge 22. Both chutes 131 are constructed and operate similarly. Each chute includes a rear wall 135 that comprises, for example, a portion of the base 126, a left side wall 133 that extends from the rear wall 135, and a right side wall 134 that extends from the rear wall 135 and is generally parallel to the left side wall 133. It should be noted that other and/or different configurations and mechanical components may be used or included as part of mounting assembly 16. The configuration and mechanical components of mounting assembly 16 as described herein are designed for the embodiment of the fluid ejecting device illustrated in FIGS. 2–4. However, the configuration and mechanical components of mounting assembly 16 will vary according to the design of both the fluid ejection system and the fluid ejection device used therewith.

Carriage datums CY1, CZ1 and CX1 formed for example as part of the base 126 are located at the bottom of the chute 131 in the vicinity of the intersection of the left side wall 133 the rear wall 135, while carriage datums CY2 and CZ2 for example as part of the base 126 are located at the bottom of the chute 131 in the vicinity of the intersection of the right side wall 134 and the rear wall 135. A carriage datum CY3 is located on the rear wall 135.

A resilient contact circuit 137 is located on the rear wall 135 of the chute and contains electrical contact bumps 139 that are urged against corresponding contact areas 71 on the flex circuit 33 of the print cartridge 22. The contact bumps 139 are arranged in a pattern having a mirror image of the pattern of contact areas 71 of a print cartridge 22 intended for use with the printer. The resilient contact circuit 137 further functions as a resilient element that urges the print cartridge PY1, PY2 against carriage datums CY1, CY2 when the print cartridge 22 is installed. By way of illustrative example, the resilient contact circuit 137 comprises a flexible circuit and resilient pad located between the flexible circuit and the rear wall 135.

A cantilever spring 146 is located adjacent the right side wall 134, and functions to urge the print cartridge away from the right side wall 134 along the X-axis, so that the print cartridge datum PX1 is snugly engaged against the carriage datum CX1 (as shown in FIG. 13).

Located in each side wall 133, 134 is shaped guide channel 140. The guide channels 140 engage lips 29 of the lid 31 of the print cartridge 22, and guide the cartridge at an appropriate elevation and pitch (or rotation) of the cartridge about the X axis as the cartridge is inserted, so as to guide the cartridge into the general vicinity of the carriage datums. By way of illustrative example, each guide channel comprise upper and lower rails 140*a*, 140*b* or a recessed slot having appropriate sides.

A cross bar 179 (see FIG. 7) spans the upper part of the front portion of chute 131 and is located above the guide channels 140. The cross bar prevents insertion of the cartridge from above, and further prevents spreading of the side walls in the event the cartridge is forced too low in the chute.

Located at the top of each chute 131 is a hinged latch assembly 150 (FIG. 7 and FIG. 11) that includes a latch support arm 151 that is pivotally attached by a hinge 153 to the top of the rear wall 135 so as to be rotatable about a hinge axis that is parallel to the X-axis. Latch hooks 155 are provided for engaging latch tabs 157 disposed at the front of the side walls 133, 134.

A pivoting biased clamp lever 159 is pivotally attached to the lower side of the latch arm 151 by a pivoting clamp hinge 161 that is displaced from the latch arm hinge 153 and parallel thereto so as to be pivotable about a pivoting clamp hinge axis that is parallel to the X axis. The clamp lever 159 extends generally toward the chute rear wall 135 when the latch is closed, and forms an acute angle with an imaginary line that extends between the latch arm hinge axis and the pivoting clamp hinge axis. The clamp lever 159 is biased by a spring 163 to pivot away from the latch arm 151. Stops 165 on either side of the clamp lever 159 limit the rotation of the track lever away from the latch arm 151.

A land 167 is disposed at the distal portion of the pivoting clamp 159 for pushing down on the top portion of the latch feature 50 of the print cartridge 11. Extending beyond the land 167 is an extension 169 that prevents the clamp 159 from jamming on the latch feature 50.

The pivoting clamp lever 159 further includes a sliding clamp 173 slidably located for movement generally orthogonally to the pivoting clamp hinge axis. The sliding clamp 173 is biased by a spring 175 to slide along the pivoting clamp lever 159 Stops 165 limit the displacement of the sliding clamp 173. A sliding clamp land 177 is disposed at the distal end of the sliding clamp 173 adjacent the pivoting clamp land 167.

In one embodiment, the cartridge 22 is inserted generally horizontally into the chute 131. The guide channels 140 control the elevation and the pitch about the X axis of the cartridge 22 as it is inserted into the chute 131, such that print cartridge datums PY1, PY2 move over the corresponding carriage datums CY1, CY2. The latch arm 151 is then pivoted downwardly which causes the sliding clamp land 177 and the pivoting clamp land 167 to eventually engage the latch feature 50 on the top of the cartridge. Continued displacement of the latch arm 151 causes the sliding clamp 173 to resiliently push on the latch feature 50 generally along the Y axis, and further causes the pivoting clamp lever 159 to push on the latch feature 50 generally along the Z axis. The push generally along the Y axis is independent of the push generally along the Z axis. The push along the Z axis causes the print cartridge datums PZ1, PZ2 to snugly seat against the carriage datums CZ1, CZ2. The push along the Y axis causes the print cartridge to pivot about the X axis so that the print cartridge datum PY3 snugly seats against the carriage datum CY3. The resilient contact circuit 137 is located so as to cause the print cartridge datums PY1, PY2 to seat snugly against the carriage datum CY1, CY2 when the print cartridge datums PZ1, PZ2 are engaged with the carriage datums CZ1, CZ2, and the print cartridge datum PY3 is engaged with the carriage datum CY3.

Other methods and arrangements for inserting print cartridge 22 into assembly 16 may be utilized, depending on the design of both parts. Further, other designs of chutes may be utilized depending on design parameters of print cartridge 22 or vice-versa.

The latch arm 151 is further displaced to engage the latch hooks 155 with the latch tabs 157, which allows the sliding clamp land 177 and the pivoting clamp land 167 to continually press against the latch feature 50 along the Y and Z axes so that the print cartridge datums PY1, PY2, PY3, PZ1, PZ2 are continually engaged with the corresponding carriage datums CY1, CY2, CY3, CZ1, CZ2. The wire spring 146 pushes the cartridge generally along the X axis so that the print cartridge datum PX1 is snugly engaged with the carriage datum CX1.

Accurate seating of the cartridge 22 on the datums, and on the Z datums PZ1, PZ2, CZ1, CZ2, in particular, directly affects print quality. In addition, the accuracy of making electrical contact between flex circuit 33 on cartridge 22 and the printer contact circuit 137 becomes greater if the cartridge 22 is predictably positioned. As described above, as the cartridge 22 goes into the chute 131, cartridge 22 is required to rotate about the X axis (the axis being located near the bottom of cartridge 22) and rock forward into position. As the cartridge rocks forward in a arcuate motion, contact areas 71 make contact with contact bumps 139 on contact circuit 137, with contact first occurring at the bottom of array 70 and progressing upward. As contact between contact areas 71 and contact bumps 139 occurs, a high friction force is created. The friction force can be sufficiently large to prevent cartridge 22 from moving completely down along the Z axis to rest in a known position on the Z datums. Alternately, the force required to fixedly and accurately seat cartridge 22 on the Z datums may be sufficiently large to damage cartridge 22 or carriage assembly 119, or both.

The fewer the contact points between contact areas 71 and contact bumps 139, the lower the force required to seat cartridge 22 into position on the Z datums. In addition, the fewer contact areas 71 positioned at the bottom of the array 70, the lower the frictional forces seen during initial engagement of the cartridge 22. The contact array 70 described above positions contact area 71 within array 70 such that fewer contacts are near the bottom of array 70 than near the top of array 70. By having fewer contact areas 71 at the bottom of array 70, a low number of contact areas 71 are initially engaged as cartridge 22 is rocked forward. As cartridge 22 is progressively rotated forward into position, contact with contact areas 71 moves progressively upward.

Proper seating of the cartridge 22 on the datums occurs to a large extent during the initial part of the insertion of the cartridge into position. Thus, it is advantageous to have an installation force curve that starts off with a lower force by having fewer contacts areas 71 located near the bottom of the cartridge. By the time the top contact areas 71 are coupled, proper seating of the cartridge is complete or nearly so. This also reduces the total energy required to seat the cartridge, even though at the end of the installation motion the installation forces are almost equal.

Figure 16A:
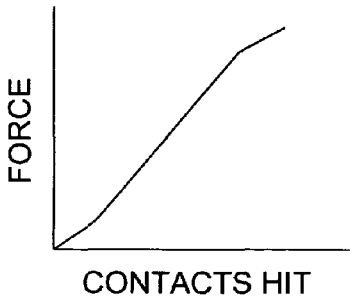
FIGS. 16A and 16B are schematic illustrations of the force curves for inserting the contact arrays of FIGS. 15A and 15B, respectively, according to one embodiment.
Figure 16B:
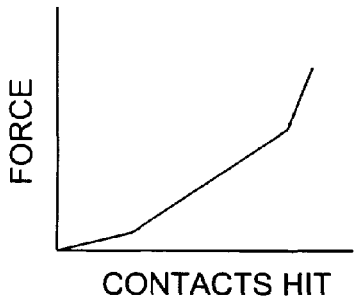

As an example, FIGS. 15A and 15B schematically illustrate a contact array having more contact areas 71 near the bottom of the array (FIG. 15A) and a contact array having fewer contact areas 71 near the bottom of the array (FIG. 15B). FIGS. 16A and 16B schematically illustrate the force curves for the contact arrays of FIGS. 15A and 15B, respectively.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A print cartridge comprising:

a cartridge body having a lower portion and a vertical wall;

a printhead attached to the lower portion;

a contact array having a first pair of columnar arrays of contact areas and a second pair of columnar arrays of contact areas disposed on the vertical wall, the columnar arrays extending along at least one half of a height of a region occupied by the contact array, the columnar arrays of each pair converging toward each other in a direction toward the lower portion; and the cartridge body being configured for rotatable installation in a printer and the contact array being configured to progressively-upwardly contact the printer during installation of the cartridge body.

2. The print cartridge of claim 1, wherein less than one-half of the contact areas are positioned in a lower half of the region occupied by the contact array.

3. The print cartridge of claim 2, wherein the contact array further includes a row of contact areas substantially perpendicular to each of the columnar arrays.

4. The print cartridge of claim 2, wherein at least one of the columnar arrays of contact areas is substantially nonlinear.

5. The print cartridge of claim 2, wherein each of the pairs of columnar arrays includes at least one ground contact area.

6. The print cartridge of claim 5, further comprising conductive traces that electrically connect the ground contact areas to the printhead.

7. The print cartridge of claim 2, wherein each of outermost transversely separated columnar arrays include more contact areas than columnar arrays between the outermost transversely separated columnar arrays.

8. The print cartridge of claim 1, wherein the region occupied by the contact array has a height of about 13.7 mm and width of about 11.3 mm.

9. The print cartridge of claim 1, wherein the region occupied by the contact array has a width of less than about 12 mm.

10. The print cartridge of claim 1, wherein the contact areas are asymmetrically spaced.

11. The print cartridge of claim 10, wherein adjacent contact areas are spaced in a range of about 1 to 3 mm.

12. A fluid ejection device comprising:

a cartridge body having a lower portion and a vertical wall;

a fluid ejecting integrated circuit attached to the lower portion; and a contact array disposed on the vertical wall and including a plurality of columns of contact areas and a row of contact areas substantially perpendicular to the columns of contact areas, and wherein the columns are arranged in pairs with each column in each of the pair converging toward the other column in the pair in a direction toward the lower portion; and wherein less than one-half of the contact areas are positioned in a lower half of a region occupied by the contact array.

13. The fluid ejection device of claim 12, wherein the plurality of columns of contact areas comprise four columns of contact areas.

14. The fluid ejection device of claim 12, wherein at least one of the columns of contact areas is nonlinear.

15. The fluid ejection device of claim 12, wherein each of the columns and row of contact areas have at least one ground contact area.

16. The fluid ejection device of claim 12, wherein the ground contact areas are electrically interconnected by conductive traces.

17. The fluid ejection device of claim 12, wherein the region occupied by the contact array has a width of less than about 12 mm.

18. The fluid ejection device of claim 12, wherein the row of contact areas is positioned in an upper half of the region occupied by the contact array.

19. An interconnect circuit comprising:

a flexible substrate; and a contact array disposed on the substrate, the contact array comprising a first pair of converging columnar arrays of contact areas, a second pair of converging columnar arrays of contact areas, and a row of contact areas substantially perpendicular to the columnar arrays; and wherein each columnar array of each pair of the columnar arrays converges toward the other columnar array of the pair of columnar arrays in a direction away from the row of contact areas and extend along at least one half of a region occupied by the contact array.

20. The interconnect circuit of claim 19, wherein the row of contact areas is in a first half of the region occupied by the contact array, and more than one-half of the contact areas are positioned in the first half of the region.

21. The interconnect circuit of claim 19, wherein at least one of the columnar arrays is substantially non-linear.

22. The interconnect circuit of claim 21, wherein the row of contact areas is substantially linear.

23. The interconnect circuit of claim 19, wherein the flexible substrate is a 48 mm substrate.

24. The interconnect circuit of claim 19, wherein the contact areas within each of the columnar arrays and row of contact areas are asymmetrically spaced.

25. A method of making a fluid ejecting apparatus, comprising:

forming a contact array circuit having a plurality of pairs of columns of contact areas, wherein the columns of contact areas of each pair converge toward a lower portion of a region occupied by the contact array, wherein each column of each pair of columns converges toward the other column of the pair of columns, and wherein less than one-half of the contact areas are positioned in a lower half of the region occupied by the contact array;

electrically connecting the contact array circuit to a fluid drop ejecting device; and attaching the contact array circuit to a cartridge body that is configured for rotatable installation within a printing device.

26. The method of claim 25, wherein electrically connecting the contact array to a fluid drop ejection device includes electrically connecting conductive traces to a thermal jetting device.

27. The method of claim 25, wherein electrically connecting the contact array to a fluid drop ejection device includes electrically connecting conductive traces to a thermal inkjet printhead, and wherein attaching the contact array circuit to a cartridge body includes attaching the contact array circuit to a print cartridge body.

28. A print cartridge comprising:

a cartridge body having a lower portion and a vertical wall, the cartridge body being configured for rotatable installation in a printer;

a printhead attached to the lower portion; and a contact array having a plurality of columns of contact areas disposed on the vertical wall, the contact array being configured to progressively-upwardly contact the printer during rotatable installation of the cartridge body where the configuration of the contact array reduces frictional forces during the rotatable installation.

* * * * *